US005751119A

United States Patent [19]

LeVasseur

[11] Patent Number: 5,751,119

[45] Date of Patent: May 12, 1998

[54] HIGH DENSITY PLUG-IN DIMMER MODULE FOR LIGHTING CONTROL SYSTEMS

[75] Inventor: Craig LeVasseur, Camarillo, Calif.

[73] Assignee: NSI Corporation, Tualatin, Oreg.

[21] Appl. No.: 588,393

[22] Filed: Jan. 16, 1996

[51] Int. Cl.[6] ..... H05B 37/00

[52] U.S. Cl. ..... 315/291; 315/DIG. 4; 336/92

[58] Field of Search ..... 315/291, DIG. 4; 336/59, 65, 66, 67, 68, 92; 361/807, 808, 809, 810, 811

[56] References Cited

U.S. PATENT DOCUMENTS

| | | | |
|---|---|---|---|
| 3,746,923 | 7/1973 | Spira et al. | 315/291 |
| 4,972,125 | 11/1990 | Cunningham et al. | 315/291 |
| 4,977,484 | 12/1990 | Cunningham et al. | 361/429 |
| 5,004,957 | 4/1991 | Cunningham | 315/199 |
| 5,352,958 | 10/1994 | Cunningham et al. | 315/291 |

*Primary Examiner*—Robert Pascal
*Assistant Examiner*—David H. Vu
*Attorney, Agent, or Firm*—Marger, Johnson, McCollom & Stolowitz P.C.

[57] ABSTRACT

A high density dimmer module controls four separate lighting circuits and provides adequate cooling while maintaining a form factor identical to conventional dimmer modules. The module includes circuit breakers arranged in stacks located adjacent to the front of the module. The circuit breaker stacks are spaced apart to allow cooling air to flow between, and to each side of, the circuit breakers. The air then flows past a power device and four toroidal inductors which are arranged behind and between the stacks. In a preferred embodiment, the module includes an input power connector positioned adjacent the rear periphery of the module chassis, first and second stacks of circuit breakers positioned adjacent the front periphery, four inductors arranged in an arcuate pattern behind the circuit breaker stacks, a power device located adjacent a sidewall of the chassis, and four output load connectors positioned adjacent the rear periphery. The circuit breaker stacks are spaced apart to allow air entering the module at the front periphery to flow between the first inductor and the first and second circuit breaker stacks, past the seconds, thirds, and fourth inductors, and out of the module at the rear periphery.

13 Claims, 7 Drawing Sheets

HIGH DENSITY PLUG-IN DIMMER MODULE FOR LIGHTING CONTROL SYSTEMS

FIELD OF INVENTION

This invention pertains generally to lighting control systems. More particularly, it pertains to interchangeable dimmer modules for controlling the light output levels from a plurality of separate lighting fixtures, such dimmer modules incorporating a high density component arrangement to provide controlled electrical power to four separate lighting fixtures or groups of fixtures while maintaining an identical form factor with prior art dual dimmers and providing adequate cooling.

BACKGROUND OF THE INVENTION

The present invention relates to interchangeable dimmer modules that are capable of providing controlled electrical power for up to four separate lighting fixtures or groups of fixtures.

Dimming control systems utilizing self contained, interchangeable dimmer modules are commonly used in theater, television, and architectural lighting applications. Such modules are typically provided in groups and are housed in a rack that is either stand-up, wall-mounted, or portable. A central controller supplies a pulse-width modulated control signal to the modules, whose pulse width controls the amount of electrical power delivered to a particular light fixture or group of fixtures.

A representative dimmer module of the kind referred to above is disclosed in U.S. Pat. No. 4,972,125 to Cunningham et al., entitled "Plug-in Dimmer Module for Lighting Control Systems" having a common assignee with the present invention. The module disclosed is designed to control the output of two separate lighting fixtures. Two circuit breakers are located adjacent the left side of the dimmer module, with two toroidal inductors located side-by-side in the module.

A module of this design is limited in the number of distinct lighting fixtures that it can control. In order to control a greater number of distinct lighting fixtures it is necessary to either utilize a greater number of dimmer modules, or increase the number of lighting fixtures that each dimmer module is capable of controlling. However, in many applications, the available space becomes a limiting factor in the total number of dimmer modules that can be used. Therefore, there exists a need for a higher density dimmer module, i.e. a dimmer module that is capable of controlling a greater number of lighting fixtures. There also exists an associated need for a novel layout for the module to respond to the increased power, and thus increased cooling needs, of these higher density dimmer modules.

SUMMARY OF THE INVENTION

The present invention responds to the needs described above by providing a dimmer module that can be easily adapted to control up to four separate lighting fixtures or groups of fixtures.

A dimmer module embodying the present invention incorporates a chassis having a left wall, a right wall and a front face plate. The face plate includes a left aperture adjacent the left wall, a right aperture adjacent the right wall and a central aperture.

A floating contact power connector is carried by a connector case attached to the rear of the chassis adjacent the left wall. The floating contact terminates in a solid conductor emerging from a central location in the connector case and extending in an arc terminating proximate a mid point of the left wall to create a flow baffle for enhanced cooling. Two circuit breakers are connected to the face plate of the chassis in a first stack, intermediate the left aperture and central aperture. Two additional circuit breakers are attached to the face plate in a second stack, intermediate the central aperture and right aperture.

A first cooling flow channel for air entering the left aperture is defined by the left wall of the chassis and the first circuit breaker stack while a second flow channel for air entering the central aperture is created by the first and second circuit breaker stacks. A flow plenum is defined in the chassis rearward of the first and second circuit breaker stacks wherein flow from the first channel and second channel merge before exiting the module through a centrally located rear vent. Four inductors are mounted in the chassis in an arcuate pattern extending through the first channel into the plenum with the first inductor located adjacent the left aperture in the face plate intermediate the left wall of the chassis and the first circuit breaker stack, the second inductor located in the entry to the plenum from the first channel, the third inductor located rearward of the first circuit breaker stack in the plenum and the fourth inductor located in the plenum adjacent the exit of the second flow channel into the plenum and the rear of the second circuit breaker stack.

A power device, including multiple printed circuit substrates for silicon controlled rectifiers and connection lead frames mounted to a formed heat sink and a companion top board carrying control circuitry for the dimmer module, is mounted adjacent the right wall of the chassis oriented to allow air flow through the right aperture of the face plate across the heat sink to exit the chassis in an exhaust aperture at the rear of the module adjacent the right chassis wall. Orientation of the lead frame connectors at the parallel edges of the printed circuit substrate allows the lead frame connectors to extend through notches in the periphery of the top board thereby eliminating any central perforation in the top board, allowing the top board to act as a baffle for air flow control over the printed circuit substrates and maximize board area for trace paths. Load connectors for the dimmer module are mounted at the rear of the chassis intermediate the plenum vent and power device exhaust aperture and a connector for control signals to the circuitry on the top board is mounted to the rear of the chassis adjacent a rear most edges of the top board intermediate the load connectors and exhaust aperture.

BRIEF DESCRIPTION OF THE DRAWINGS

Embodiments of the present invention will be better understood with reference to the following drawings wherein.

DETAILED DESCRIPTION

Figure 1:
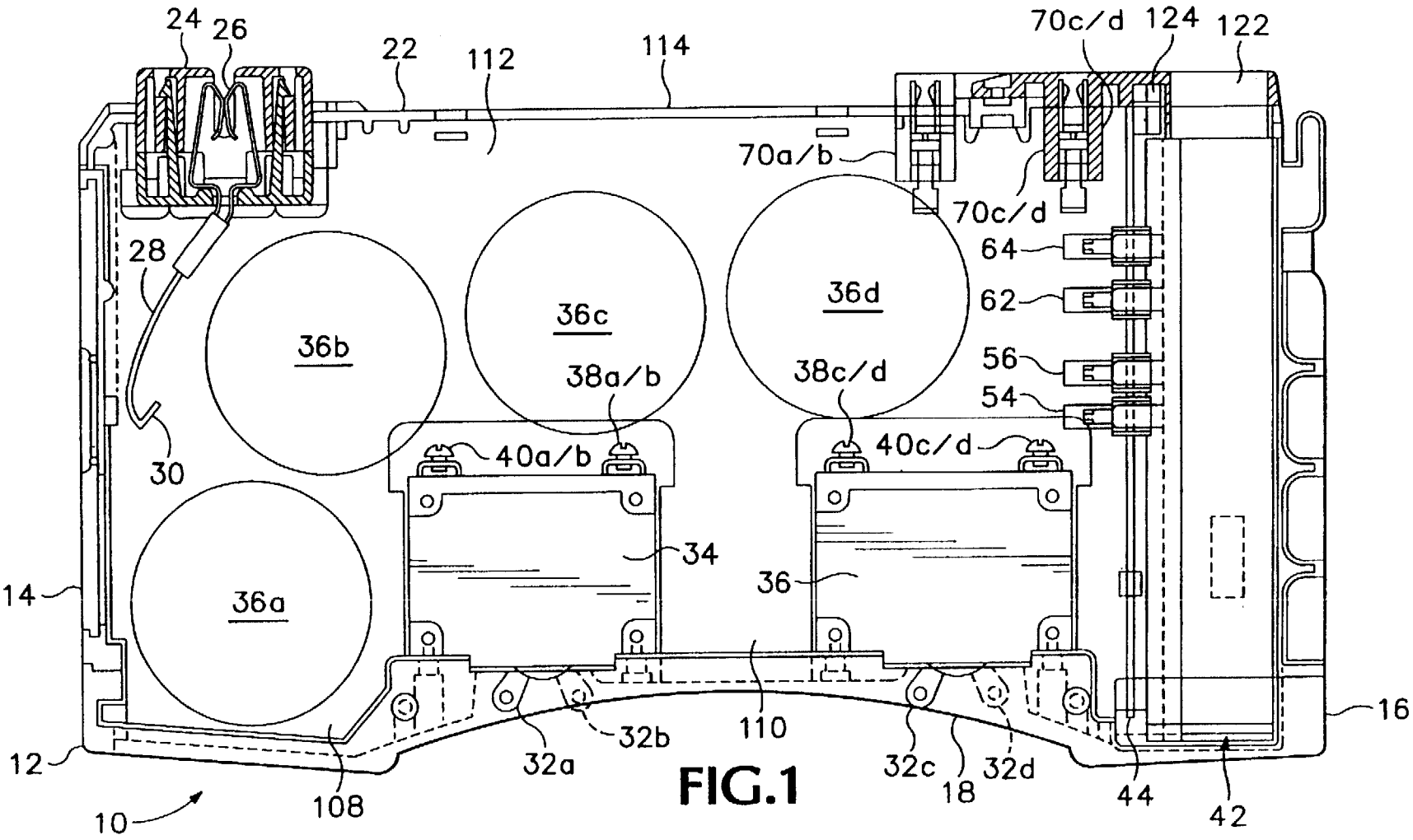
FIG. 1 is a top view of the chassis.
Figure 2:
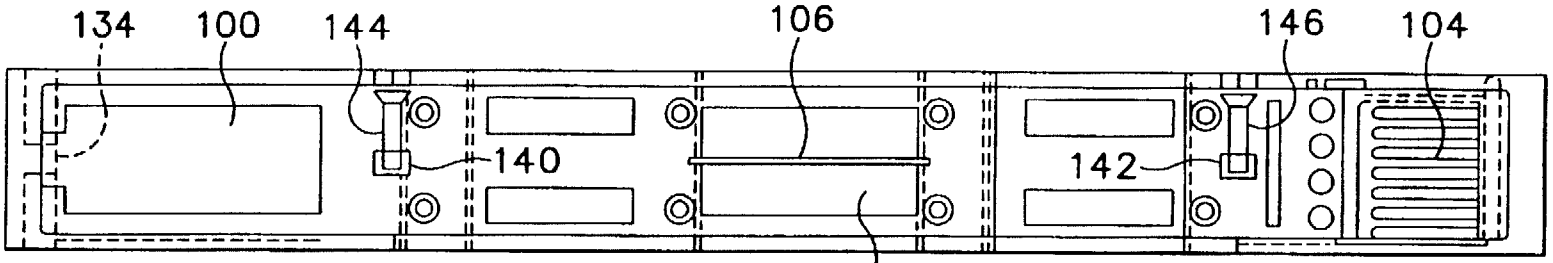
FIG. 2 is a front view of the chassis.

The physical design of a dimmer module according to the present invention is illustrated in FIGS. 1 and 2. The dimmer module 10 comprises a chassis 12 formed, in the embodiment shown, from die-cast aluminum. The chassis incorporates a left side wall 14, a right side wall 16 and a face plate 18.

As depicted in FIG. 1 the dimmer module is capable of controlling four separate lighting fixtures or four groups of interconnected fixtures. Input power is received by the module through connector 24 located adjacent the left wall of the chassis. A floating contact 26 is incorporated in the power connector to accommodate tolerance buildup in mating the connector module to dimmer racks. The floating contact includes an extended conductor 28 which terminates in blade connectors 30. Four circuit breakers 32*a*, 32*b*, 32*c* and 32*d* control the input power for the four loads of the dimmer module. Breakers 32*a* and 32*b* are mounted in a first stack 34 attached to the face plate of the chassis while breakers 32*c* and 32*d* are mounted in a second stack 36.

Figure 3A:
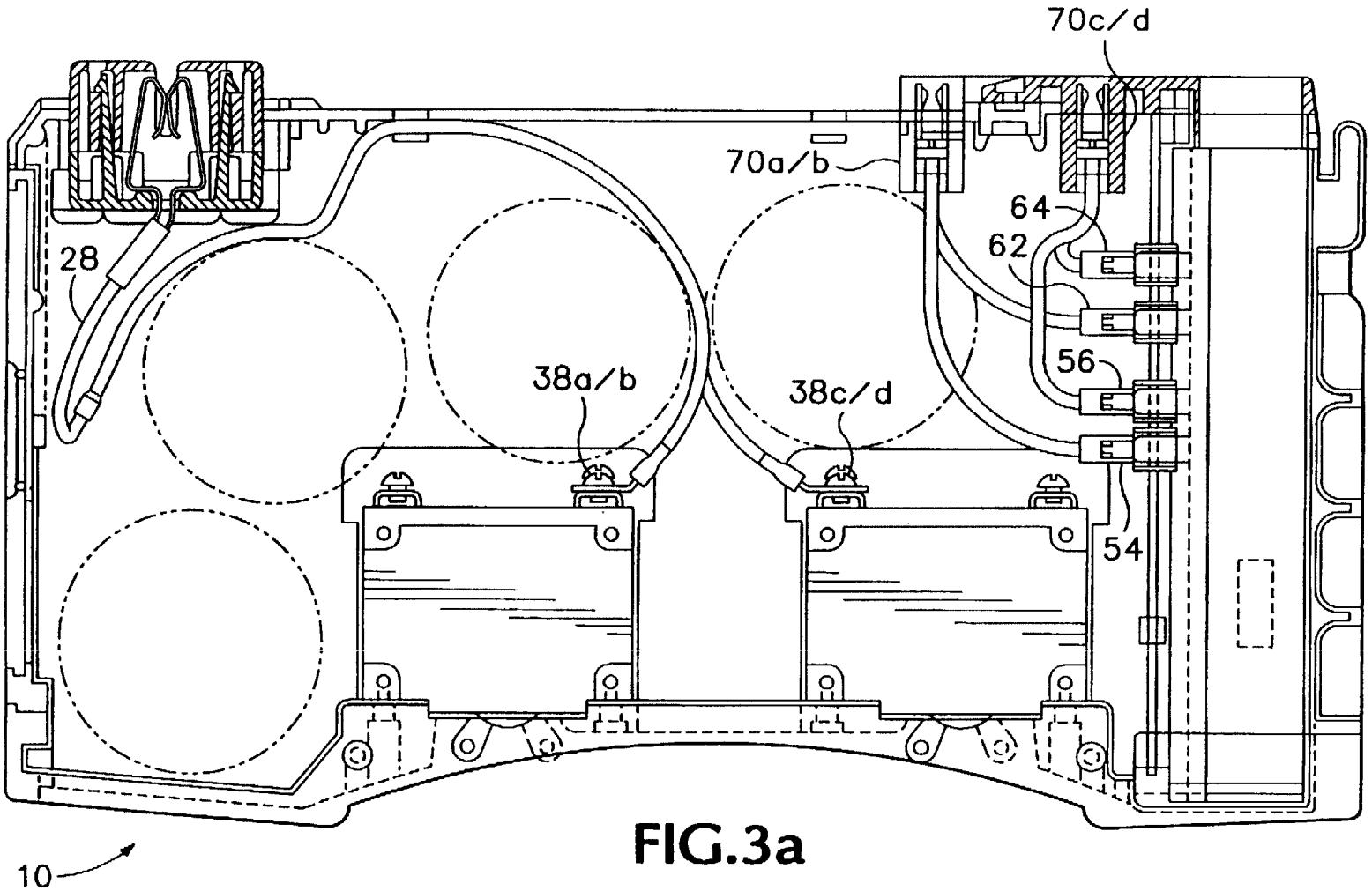
FIG. 3*a* is a top view of the chassis showing electrical connection of the power connector to the first and second circuit breaker stacks and connection from the SCR output lead frames to the load connectors.
Figure 3B:
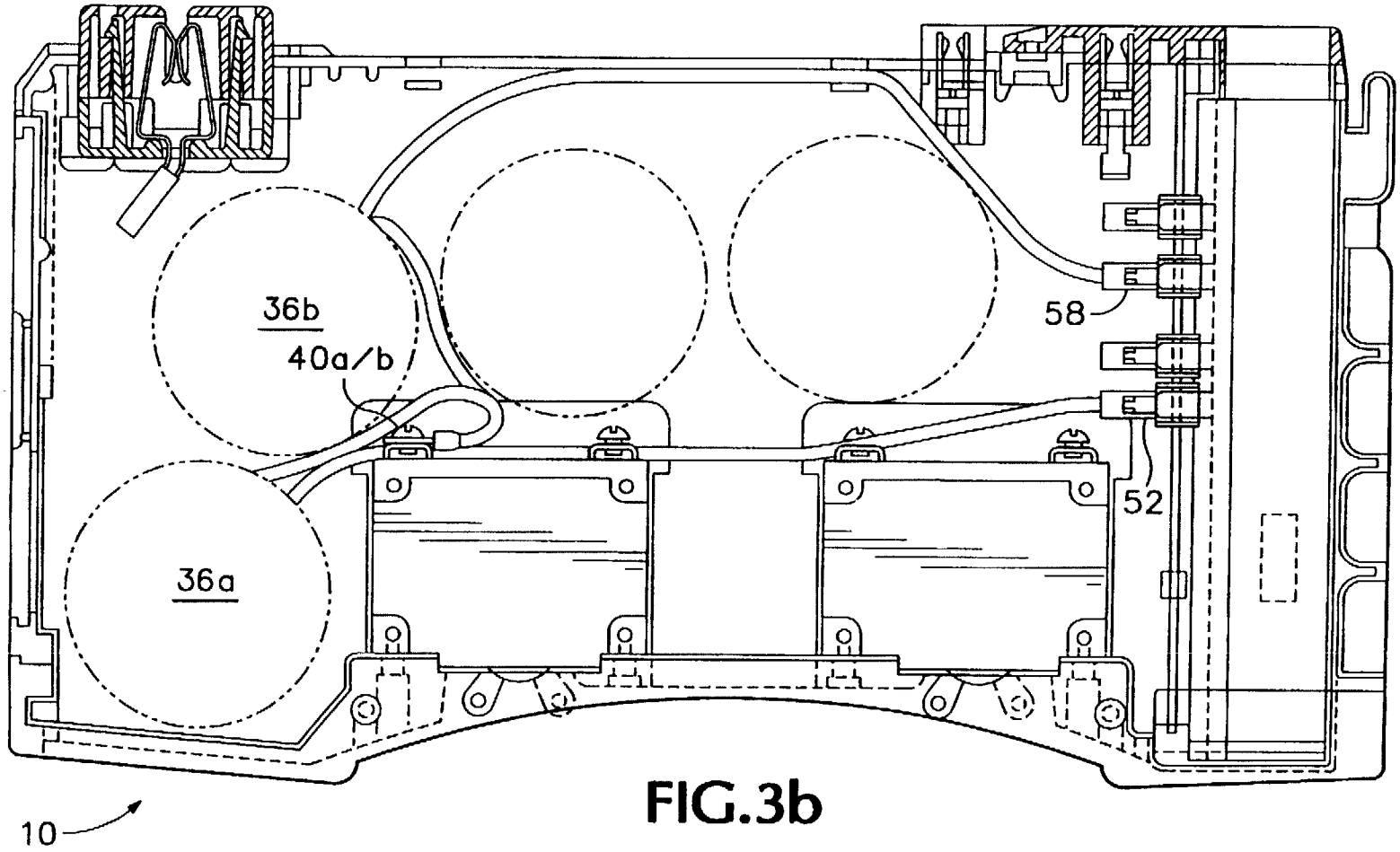
FIG. 3*b* is a top view of the chassis showing electrical connection of the first circuit breaker stack to the first and second inductors and the first and second inductors to the SCR input lead frames.
Figure 3C:
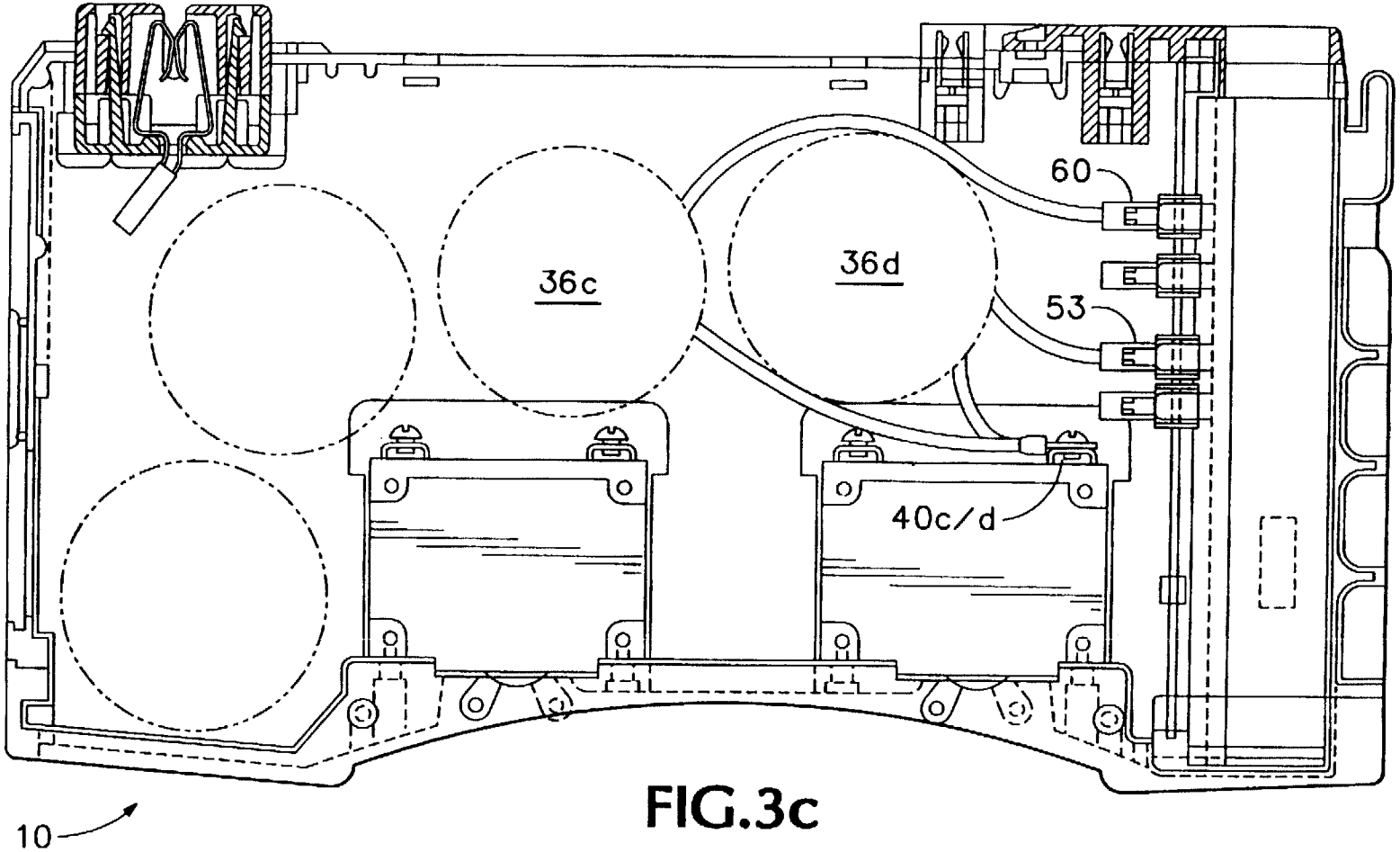
FIG. 3*c* is a top view of the chassis showing electrical connection from the second circuit breaker stack to the third and fourth inductors and from the third and fourth inductors to the SCR lead frames.

Four inductors 36*a*, 36*b*, 36*c* and 36*d* comprising toroidal chokes for current supply in the dimming control circuits are mounted in the chassis. Input power is provided from the blade connectors of the conductor extension to the line contacts 38*a*, 38*b*, 38*c* and 38*d* of the circuit breakers as best shown in FIG. 3*a*. Vertical interconnection of the breakers in the stack is accomplished, in the embodiment shown in the drawings, through a standard bus bar arrangement. As shown in FIG. 3*b* power is routed from the load contacts 40*a* and 40*b* of the first circuit breaker stack to the inputs of inductors 36*a* and 36*b* respectively. Similarly, load outputs 40*c* and 40*d* of the second circuit breaker stack are connected to the inputs of inductors 36*d* and 36*c* as best seen in FIG. 3*c*.

Figure 5:
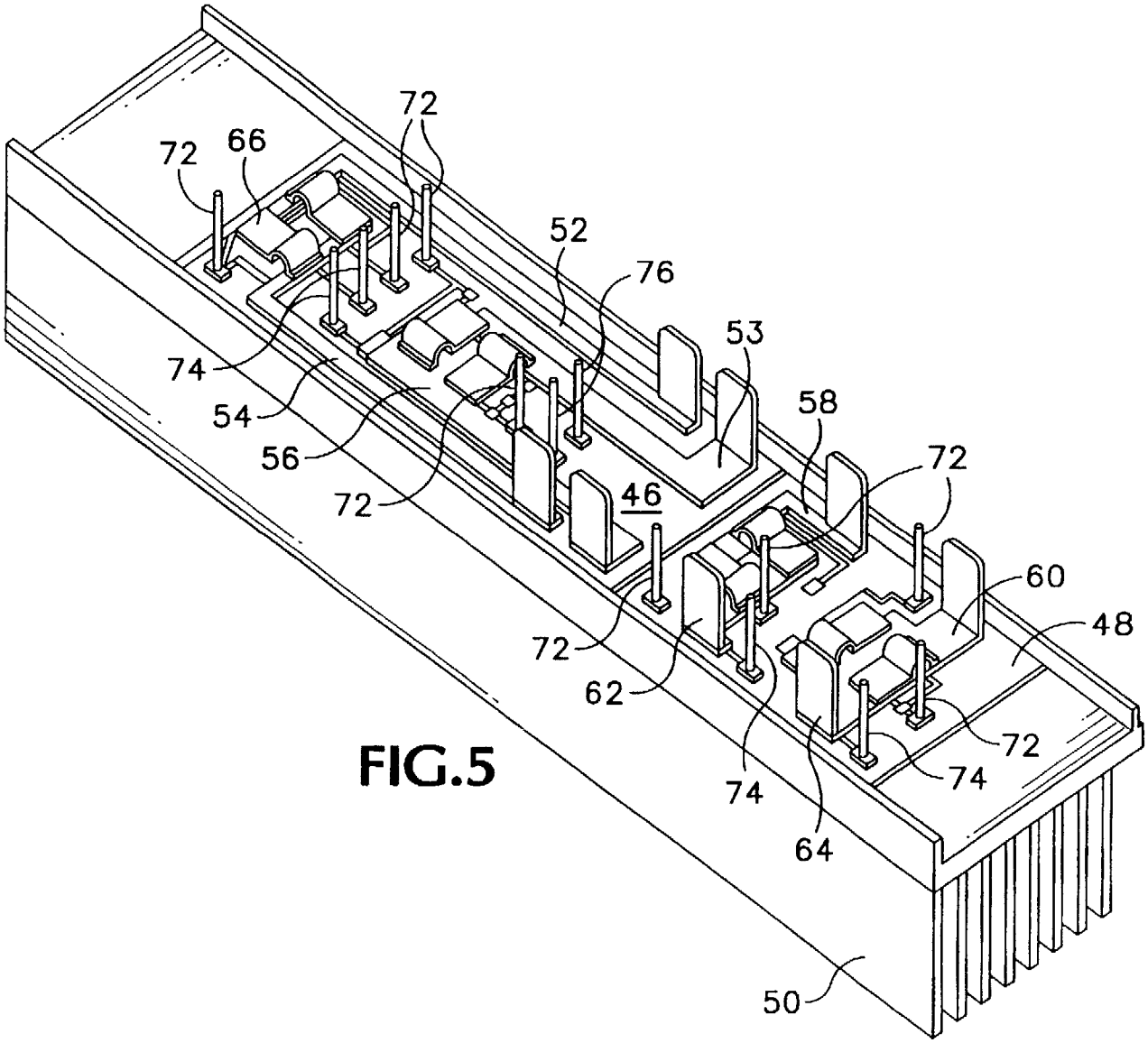
FIG. 5 is an isometric view of the printed circuit substrates, lead frames and heat sink for the power device.

A power device generally designated 42 is mounted in the chassis adjacent the right wall. The power device comprises a top board 44 which incorporates control circuitry for the dimmer module, and printed circuit substrates 46 and 48 which are mounted to a finned heat sink 50 as best seen in FIG. 5. Each substrate carries two dimmer circuits, each circuit designed to control the power to a single lighting fixture or group of fixtures. Input lead frames 52 and 53 and output lead frames 54 and 56 are mounted to the first substrate while input lead frames 58 and 60 and output lead frames 62 and 64 are mounted to the second substrate. SCRs generally designated 66 are surface mounted on the lead frames and cross strapped in an anti-parallel circuit relation in a conventional manner. Power control for two dimming circuits is provided through SCRs mounted on the first substrate while power control of the second two dimming circuits is provided through SCRs mounted on the second substrate. Both substrates are mounted to a common heat exchanger for improved packaging efficiency and thermal control.

Figure 6:
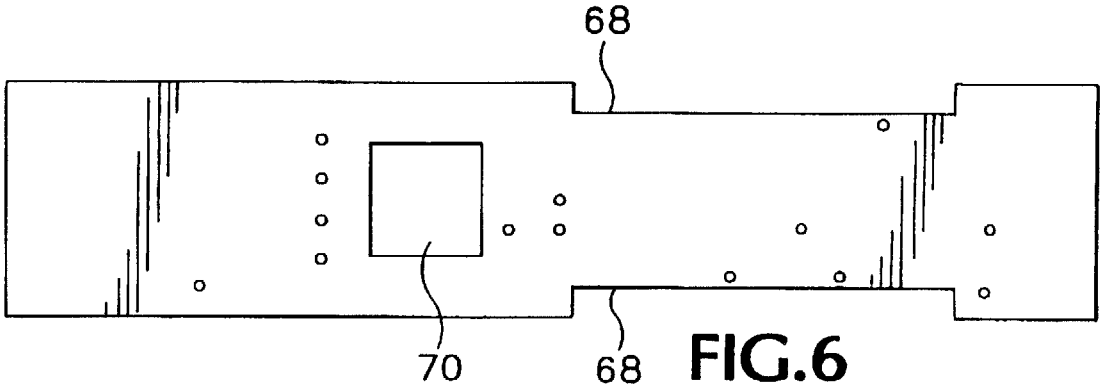
FIG. 6 is a top view of the top board of the power device.

Each of the lead frames terminates in a blade connector perpendicular to the surface of the substrate and located proximate the edge of the substrate. The connectors on the lead frames extend through edge cutouts 68 in the top board for electrical connection as best seen in FIG. 6. As shown in FIG. 3*b*, the outputs of inductors 36*a* and 36*b* are connected to lead frames 52 and 58 respectively, while as shown in FIG. 3*c* the outputs of inductors 36*c* and 36*d* are connected to lead frames 60 and 53. As shown in FIG. 3*a*, output lead frames 54 and 62 are connected to load connectors 70*a* and 70*b* mounted in the rear of the chassis intermediate the plenum vent 114 and power device exhaust aperture 122 while output lead frames 56 and 64 are connected to load connectors 70*c* and 70*d* mounted adjacent connectors 70*a* and 70*b* in the rear of the chassis.

Extension of the lead frame connectors through the edges of the top board eliminates perforations in the top board required for such connections. The top board therefore provides a substantially solid baffle to assist in air flow control for cooling of the power device and allows greater flexibility in design and routing of circuit traces on the top board by maximizing available board area.

Control of the SCRs in the power device is accomplished by a microcontroller 70 and conventional circuitry using gate connections generally designated 72 and voltage sense connections generally designated 74 in FIG. 5. A thermistor mounted to the SCR substrate and connected to the top board through connection 76 allows temperature monitoring of the power device by the microcontroller. Communication by the microcontroller is accomplished through connector 124 located in the rear wall of the module adjacent the load connector.

Figure 7C:
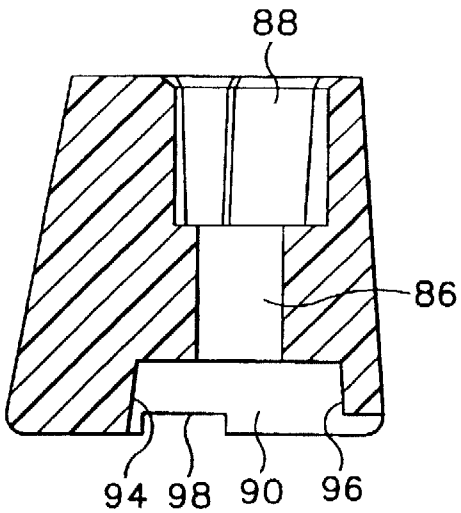
FIG. 7*c* is a sectional side view along line c—c of FIG. 7*a*.
Figure 7B:
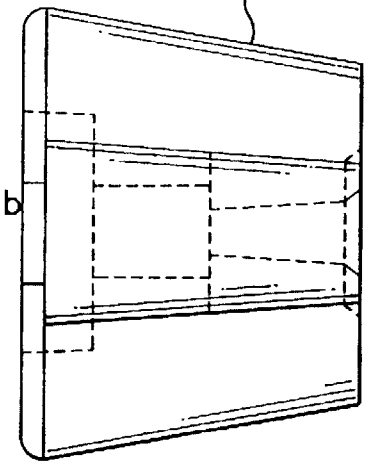
FIG. 7*b* is a side view of the choke holder.
Figure 7A:
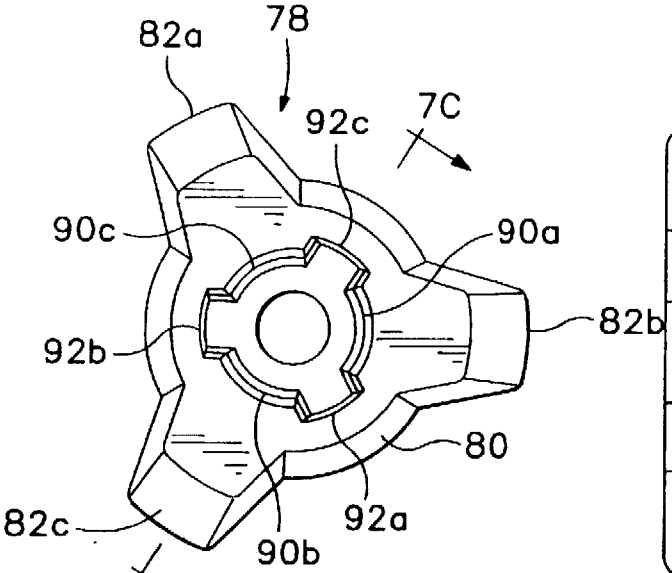
FIG. 7*a* is a top view of the choke holder.

A molded choke holder 78, illustrated in FIG. 7*a*–*c*, is used to secure each of the inductors to the chassis. The choke holder includes a frustoconical center portion 80, from which three evenly spaced projections 82*a*, 82*b*, 82*c* extend. The inductors are placed over the choke holder, so that the holder is inserted through the hole at the center of the inductor. The projections of the holder are wedged against the inner surface of the inductor, securing the inductor inside the chassis. The projections 82*a*, 82*b*, 82*c* are relatively thick to avoid potential problems associated with brittleness.

The choke holder, in the embodiment shown in the drawings, is molded from Dupont Rynite®. The projections on the holder are evenly spaced at substantially 120° around the center portion and have an exterior surface 84 comprising arc segments of a frustoconical surface. The center portion includes an axial cylindrical bore 86 which terminates at its upper end in a relief cavity 88 and its lower end in a relief cavity 90. The upper relief cavity is formed by arc segments of concentric substantially cylindrical surfaces. Arc segments 90*a*, 90*b* and 90*c* are radially adjacent the projections of the holder and have a first diameter while second arc segments 92*a*, 92*b* and 92*c* have a larger diameter than the first arc segments, extending into the center portion intermediate the projections. The lower relief cavity similarly comprises two sets of substantially cylindrical arc segments the first arc segments radially aligned with the projections and having a first diameter the second arc segments having a greater diameter than the first arc segments extending into the central portion intermediate the projections. The lower relief cavity also includes notches 98 extending through the bottom edge of the center portion in alignment with the second arc segments.

The combined upper and lower relief cavities allow flexure of the projections to enhance frictional engagement of the substantially cylindrical inner surface of the inductors wedged thereon.

The increased density of the dimmer module increases the amount of heat produced inside of the module. As a result of this increased heat production an improved cooling scheme is required within the module to protect the various components of the module. Therefore, the present invention provides a novel cooling arrangement.

The dimmer module of the present invention is designed for use in a dimmer rack employing cooling fans drawing air through the dimmers into a common cooling flow chamber internal to the rack as known in the prior art.

As best seen in FIGS. 1 and 2 the face plate of the chassis incorporates a left cooling aperture 100, a central cooling aperture 102 and a right cooling aperture 104. The central cooling aperture is horizontally bifurcated by a vane 106. A first cooling flow channel 108 receiving air from the left aperture is formed by the left wall of the chassis and the first circuit breaker stack 34. A second flow channel 110 receiving cooling air from the center aperture is formed intermediate the first and second circuit breaker stacks. Air flowing from the first and second channels enters a plenum 112 and exits through a rear vent 114.

The inductors carried within the chassis are arranged in an arc extending through the first channel into the plenum. The first inductor 36*a* is located intermediate the left wall and first circuit breaker stack adjacent the face plate. The second inductor 36*b* is located to the rear and inboard of the first inductor in the interface between the first channel and plenum. Airflow through the first channel into the plenum provides cooling for the first and second inductors. The third inductor is located inboard and rearward from the second inductor in the plenum while the final inductor 36*d* is located to the rear and right of the third inductor in the plenum. Air flow from the second channel impinges on the third and fourth inductors merging with the flow from the first channel in the plenum prior to exhausting through the vent.

Figure 4:
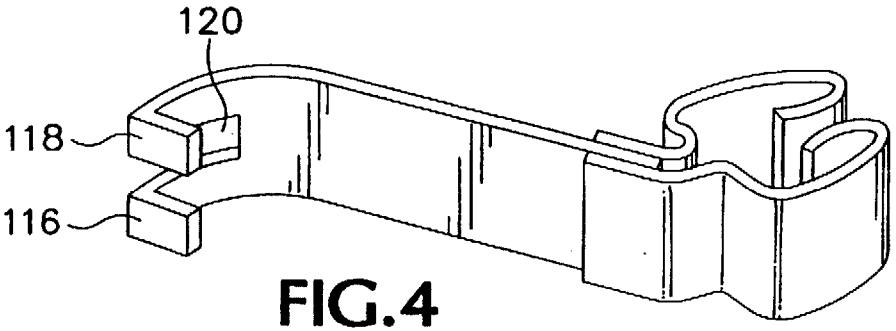
FIG. 4 is an isometric view of the power connector solid conductor extension and curved airflow baffle.

The extended solid conductor 28 of the power connector has a curved shape to act as a baffle for air flowing through the first channel to turn the flow from the first channel into the plenum to enhance cooling. As best seen in FIG. 1, the curved conductor extends from a point proximate the center of the left wall inboard to the case of the connector mounted in the chassis. As shown in FIG. 4, the extended conductor terminates in two blade connectors 116 and 118 bent at a reverse angle to allow ease of connection to the electrical contacts on the circuit breakers. A slot 120 extends into the solid conductor extension between the reverse angle blade connectors to enhance airflow.

Cooling air for the power device is provided through the right aperture in the front plate of the chassis and is directed over the fins of heat sink 50 and exits the chassis through an exhaust aperture 122 in the rear wall 22 adjacent the right chassis wall.

Figure 8:
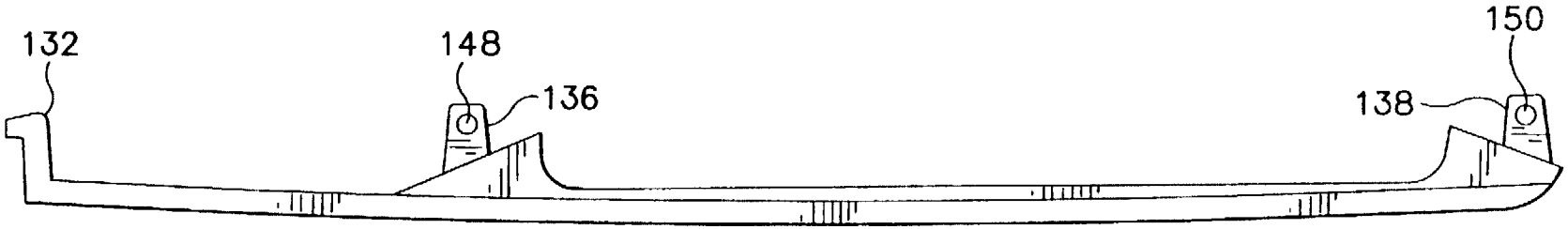
FIG. 8 is a top view of the module handle.

FIG. 8 shows a handle 130 for the dimmer module which assists in easy insertion and removal of the module from a dimmer rack. The handle is attached to the face plate of the module by inserting hooked tang 132 into a receiving aperture 134 at the left extremity of the face plate as best seen in FIG. 2. The handle is then rotated into position inserting tangs 136 and 138 into apertures 140 and 142 respectively in the face plate. Tapered holes 144 and 146 allow insertion of self-tapping retaining screws (not shown) through the top of the chassis casting to engage apertures 148 and 150 in the tangs of the handle thereby affixing the handle to the module face plate.

Having now described the invention in detail as required by the patent statutes, those skilled in the art will recognize modifications and substitutions to elements of the embodiments of the invention disclosed. Such modifications and substitutions are within the scope and intent of the invention as defined in the following claims.

What is claimed:

1. A dimmer module capable of providing controlled electrical power to four separate lighting fixtures or groups of fixtures, the dimmer module comprising:

a chassis having a first side wall, a second side wall opposite the first side wall, and a front face plate, said face plate having a first aperture adjacent the first wall, a second aperture adjacent the second wall, and a central aperture intermediate the first and second apertures;

an electrical connector for input power attached to the chassis adjacent a rear end of the first wall;

first and second circuit breakers, attached to the face plate in a first stack intermediate the first and central apertures and third and fourth circuit breakers, attached to the face plate in a second stack intermediate the central and second apertures, said first stack forming cooperatively with the first wall a first airflow channel for cooling air entering the first aperture and the first and second stacks cooperatively forming a second airflow channel for cooling air entering the central aperture, each of said circuit breakers electrically connected to the power connector;

first, second, third, and fourth toroidal inductors, arranged in an arcuate pattern extending through the first channel into a plenum in the chassis rearward of the first and second circuit breaker stacks, said plenum adjacent a centrally located rear vent in the chassis, each inductor electrically connected to a respective circuit breaker;

a power device including printed circuit substrates for four silicon controlled rectifier (SCR) circuits and connection lead frames mounted to a heat sink, each of said SCR circuits connected to a respective inductor, and a companion top board carrying control circuitry for the SCR circuits, said power device mounted adjacent the second wall of the chassis and oriented to allow air flow through the second aperture of the face plate across the heat sink to exit the chassis in an exhaust aperture at the rear of the chassis adjacent the second wall; and four load connectors for delivering electrical power to four separate lighting devices or groups of lighting devices from a respective SCR circuit, said load connectors mounted intermediate the central vent and the exhaust aperture in the chassis.

2. A dimmer module as recited in claim 1 wherein the first inductor is located adjacent the first aperture in the face plate intermediate the first wall of the chassis and the first circuit breaker stack, the second inductor located in an entry to the plenum from the first channel, the third inductor located rearward of the first circuit breaker stack in the plenum and the fourth inductor located in the plenum adjacent an exit of the second flow channel into the plenum and the rear of the second circuit breaker stack.

3. A dimmer module as recited in claim 1 wherein the lead frames of the power device include blade connectors extending perpendicular to the substrates and extending through notches in at least one peripheral edge of the top board thereby eliminating any central perforation in the top board, whereby the top board acts as a baffle for air flow control over the substrates.

4. A dimmer module as recited in claim 1 wherein the power device includes at least two substrates mounted to the heat sink, each of said substrates supporting SCR circuits to control two separate lighting fixtures or groups of fixtures.

5. A dimmer module as recited in claim 1 wherein the input power connector includes a contact having a solid conductor emerging from a central location in a connector case and extending in an arc terminating proximate a mid point of the first wall of the chassis to create a flow baffle in the first cooling flow channel.

6. A dimmer module capable of providing separate control of electrical power to four lighting circuits comprising:

a chassis having a first side wall, a second side wall opposite the first side wall, a front periphery, and a rear periphery;

an input power connector positioned adjacent the rear periphery;

first and second circuit breakers arranged in a first circuit breaker stack adjacent the front periphery;

third and fourth circuit breakers arranged in a second circuit breaker stack adjacent the front periphery;

a first inductor proximate the front periphery;

second, third, and fourth inductors positioned rearward of the first and second circuit breaker stacks and the first inductor;

a power device located adjacent the second sidewall; and four output load connectors positioned adjacent the rear periphery;

wherein the first inductor and the first and second circuit breaker stacks are spaced apart to allow air entering the module at the front periphery to flow between the first inductor and the first and second circuit breaker stacks, past the second, third, and fourth inductors, and out of the module at the rear periphery.

7. A dimmer module according to claim 6 wherein:

the first inductor is positioned between the first side wall and the first circuit breaker stack;

the first circuit breaker stack is positioned between the first inductor and the second circuit breaker stack; and the second circuit breaker stack is positioned between the first circuit breaker stack and the power device.

8. A dimmer module according to claim 7 further including a front face plate having a first aperture adjacent the first side wall, a second aperture adjacent the second side wall, and a central aperture intermediate the first and second apertures, wherein the apertures are positioned such that air entering the first aperture flows between the first side wall and the first circuit breaker stack, air entering the central aperture flows between the first and second circuit breaker stacks, and air entering the second aperture flows over the power device.

9. A dimmer module according to claim 6 wherein the input power connector is positioned proximate the first side wall.

10. A dimmer module for independently controlling electrical power to four separate lighting circuits comprising:

a chassis having a first side, a second side opposite the first side., a front and a back;

a power device positioned within the chassis proximate the second side of the chassis;

a first row of components positioned within the chassis proximate the front, said first row including a first stack of two circuit breakers, a second stack of two circuit breakers, and a first inductor; and a second row of components positioned within the chassis rearward of the first row of components, said second row including second, third, and fourth inductors;

wherein the components in the first row are spaced apart to allow air entering the front of the module to flow between the components in the first row, past the components in the second row, and out of the back of the module.

11. A dimmer module according to claim 10 wherein:

the first inductor is positioned between the first side and the first circuit breaker stack;

the first circuit breaker stack is positioned between the first inductor and the second circuit breaker stack; and the second circuit breaker stack is positioned between the first circuit breaker stack and the power device.

12. A dimmer module according to claim 11 further including a front face plate having a first aperture adjacent the first side, a second aperture adjacent the second side, and a central aperture intermediate the first and second apertures, wherein the apertures are positioned such that air entering the first aperture flows between the first side and the first circuit breaker stack, air entering the central aperture flows between the first and second circuit breaker stacks, and air entering the second aperture flows over the power device.

13. A dimmer module according to claim 10 wherein the input power connector is positioned proximate the first side.

* * * * *

UNITED STATES PATENT AND TRADEMARK OFFICE

CERTIFICATE OF CORRECTION

PATENT NO. : 5,751,119

DATED : May 12, 1998

INVENTOR(S) : LeVasseur

It is certified that error appears in the above-identified patent and that said Letters Patent is hereby corrected as shown below:

Column 8, line 11 "first side,, a front and a back:" should read --first side, a front and a back;--

Signed and Sealed this

Second Day of May, 2000

*Attest:*

Q. TODD DICKINSON

*Attesting Officer*

*Director of Patents and Trademarks*